US005538223A

United States Patent [19]

Scace et al.

[11] Patent Number: 5,538,223

[45] Date of Patent: Jul. 23, 1996

[54] SINGLE LINE MULTIPLE PURCHASE BLOCK AND TACKLE SYSTEM

[76] Inventors: Gregory Scace, Gaithersburg, Md.; Michael D. Zuteck, Kemah, Tex.

[21] Appl. No.: 230,594

[22] Filed: Apr. 21, 1994

[51] Int. Cl.[6] ..... B66D 3/08

[52] U.S. Cl. ..... 254/399; 254/391; 254/415

[58] Field of Search ..... 254/391, 398, 254/399, 415, 335, 336, 337

[56] References Cited

U.S. PATENT DOCUMENTS

| | | | |
|---|---|---|---|
| 889,488 | 6/1908 | Smith | 254/399 |
| 1,381,011 | 6/1921 | Quick | 254/218 |
| 3,714,838 | 2/1973 | Gilson | 254/391 |
| 3,794,185 | 2/1974 | Kroll et al. | 254/399 |
| 4,084,794 | 4/1978 | Wallace | 254/299 |
| 4,721,286 | 1/1988 | Hey et al. | 254/399 |

FOREIGN PATENT DOCUMENTS

| | | | |
|---|---|---|---|
| 346 | 1/1979 | Japan | 254/399 |
| 835940 | 6/1981 | U.S.S.R. | 254/399 |

*Primary Examiner*—Joseph J. Hail, III
*Attorney, Agent, or Firm*—Juettner Pyle Lloyd & Piontek

[57] ABSTRACT

A block and tackle system having two different purchases is operated from a single line. The system includes a primary purchase system and a secondary system having a higher purchase than the primary system. The primary and secondary systems are separated by a one-way block, and the secondary system is connected back to a floating block in the primary system. The secondary system is activated upon initial ease of the line from any given position, with the one-way block locking the line in the ease direction.

13 Claims, 4 Drawing Sheets

14
2
6
4
22
7
3
32
30
26
24
28
8
18
20
80
82
16
5

SINGLE LINE MULTIPLE PURCHASE BLOCK AND TACKLE SYSTEM

BACKGROUND OF THE INVENTION

This invention relates generally to block and tackle systems and more particularly to tackle systems which can be operated at more than one mechanical advantage by hauling and release of a single line.

Pulleys or bearing blocks are used extensively on sailing craft to allow adjustments to various parts of the rigging and especially the sails. For example, a mainsheet system may be employed between the boom attached to the foot of a mainsail and the aft deck of a boat. These systems typically comprise one or more blocks attached to the boom and one or more blocks attached to the deck, with a single line passing or reeved between successive blocks to provide a simple purchase system, with the mechanical advantage depending on the number of blocks used and the number of falls or passes extending between the blocks. The bitter end of the sheet or line may be either secured to the deck or the boom. The free end of the line is either pulled in or released to control the horizontal and vertical position of the boom. Some of the mainsheet systems in current use are shown on pages 208 and 209 of the 1994 catalog of Harken Yacht Fittings.

Sheeting systems for sails which are subjected to high forces involve various tradeoffs if the sheeting is done by hand. For example, it is important to be able to sheet the sail in and out quickly as the boat is being turned, in order to retain maximum speed, and also for reasons of safety. Such objective dictates a low purchase system.

In contrast, as the mainsheet is repeatedly trimmed and released to fine tune the sail for maximum speeds, the end of the boom is pulled by maximum forces on the sail, and the load on the system is very high. This consideration dictates the need for a block and tackle system having a high purchase. For example, high performance catamarans typically use 8:1 mainsheet systems, and a three foot adjustment of the boom requires the sailor to haul in twenty-four feet of line. If a lower ratio system was employed, the sailor would not be able to easily adjust the sail on a continuous basis without undue effort and fatigue.

When sailing, and particularly under competitive racing conditions, the sheets for the sails are initially trimmed in for a given point of sail. The sheets are then continually eased out and trimmed in, in order to obtain maximum speed, and to accommodate changes in the wind and water. The continued adjustments quickly lead to fatigue if a low purchase system is employed.

For this reason, as indicated above, two separate systems having different ratios have been employed, but these systems are complex and require the use of two separate systems and sheets. Another system is shown in EP 79593, which uses a single line that is doubled back through the system, with the free ends of the line passing through side-by-side cleats. Both lines are moved together for coarse adjustments, and for fine adjustments, one line is secured and the other is moved. In effect, the system uses two sheets, and two free ends must be employed.

SUMMARY OF THE INVENTION

From the foregoing, it will be appreciated that single line pulley and tackle systems having both low and high purchase modes have been long sought after, but no proposals have been made up to the time of the present invention.

In accordance with the present invention, a block and tackle system adjustable from a single line is provided with a primary system and an internal secondary system providing a higher mechanical advantage than the primary system and sharing components of the primary system. The systems are separated by a one way block, which provides frictional resistance to line movement in the direction of line release. The friction developed by the mainsheet on the one way block is sufficient to prevent movement of the mainsheet downstream of the block when the line is initially eased, in order to actuate the secondary system.

One of the components in the system is a block secured to a tether or other limiter and movable between fully extended and collapsed positions. The tethered block is fully extended during coarse (low purchase) sheeting in and collapsed against a stop during coarse sheeting out. In intermediate positions of the tether, the fine adjustment (high purchase) is engaged. The length of the tether determines the range of line operation of the higher ratio system.

The secondary system is operatively connected between the one way block and the tethered block. In order to obtain maximum mechanical advantage in the secondary system, a secondary line of finite or limited length is preferably employed, and such line passes through a floating block secured to the bitter end of the mainsheet, around a secondary block secured to the deck, and is also secured to the floating tethered block, in order to provide a cascading or compound secondary system.

In summary, the two purchase block and tackle system is arranged to be connected between two parts which are relatively moveable toward and away from each other. One of the parts, i.e., the boom, has at least a pair of pulleys or blocks, with the line being reeved between the pulleys and through an intermediate floating pulley tethered to the other part, i.e., the deck. In addition, the line passes through a one-way block which is positioned downstream in the system of the floating tethered block. Between the one-way block and tethered pulley is provided at least one additional pulley or pulley system connecting the bitter end of the line back to the tethered pulley for providing an increased mechanical advantage when the line is locked by the one-way block. The tethered pulley, when operating with the secondary system, acts as a floating multiplier.

The portion of the mainsheet between the sailor and the one-way block can be considered as the upstream part of the line, and the portion beyond the one-way block can be considered as the downstream portion. In the low purchase mode, both portions move as one, with the one-way block rotating in the haul direction and the line slipping over the sheave of the one-way block in the release direction. In the high purchase mode, the mainsheet is temporarily locked on the one-way block, and the line is pulled in opposite directions from the one-way block. When the line is initially eased, the locked portion of the sheet activates the secondary system.

The block and tackle system of the present invention is particularly suitable for use as a mainsail sheeting system, but may also be used in other applications where two different mechanical advantages would be useful. A particular advantage is that the system may be designed to provide a variety of ratios in the primary and secondary system, in order to provide ratios most suitable for particular sailboats, or for a particular use.

Most importantly, the block and tackle system requires only handling of the free end of only one line instead of two lines in the previous arrangements, and the system is convenient and easy to use.

THE DRAWINGS

DESCRIPTION OF THE PREFERRED EMBODIMENTS

Figure 11:
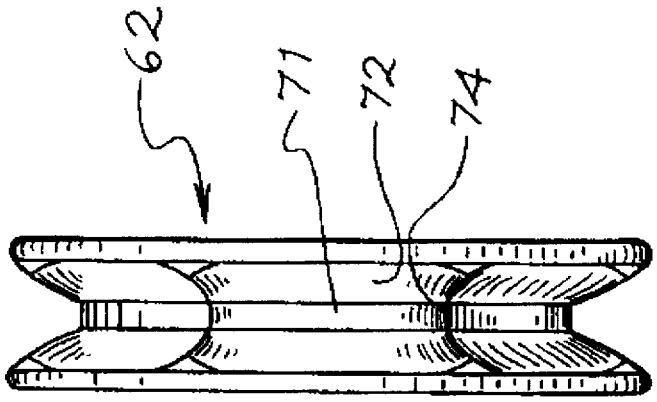
FIG. 11 is an isolated end view of the sheave of the block shown in FIG. 10.
Figure 10:
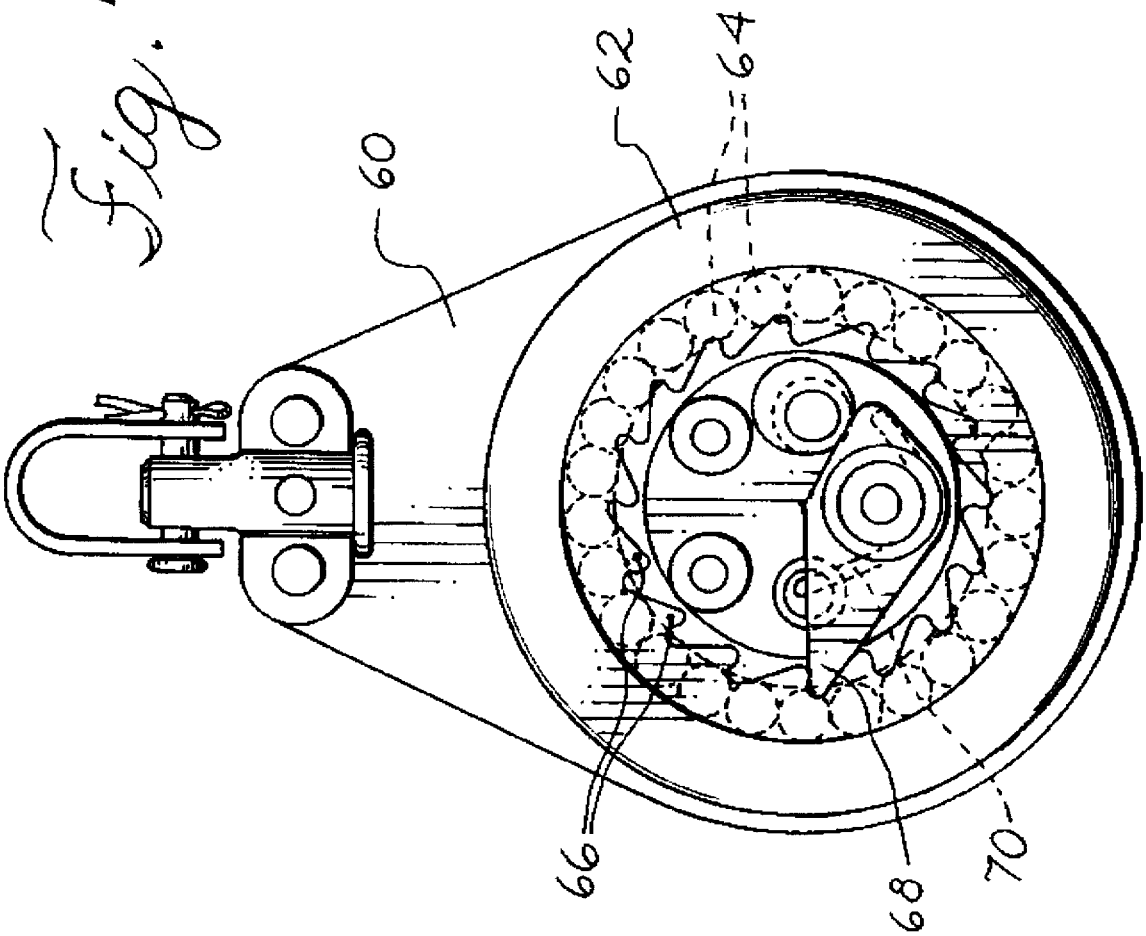
FIG. 10 is a vertical sectional view of a conventional ratchet block used in the system of the present invention.

The terms "pulley" or "bearing block" as used herein are conventional pulleys available from a variety of sources and include a sheave which is freely rotatable about an axis in both directions. The sheave is typically supported by bearings between the sheave and an inner race. Side plates extend from the inner race to a head, from which the pulley may be suspended. The term "one-way block" refers to a pulley which locks in one rotary direction enabling gripping frictional forces to be developed on the line, while being capable of free rotation in the other direction. A block of this nature is shown in FIGS. 10 and 11 hereof, taken from Gilson U.S. Pat. No. 3,714,838, incorporated herein by reference and described herein in more detail. Although the pulley and tackle system will be described as a mainsheet system for sailing vessels, employing terms of the sailing art, it will be appreciated that the system may be employed as any block and tackle system.

Figure 4:
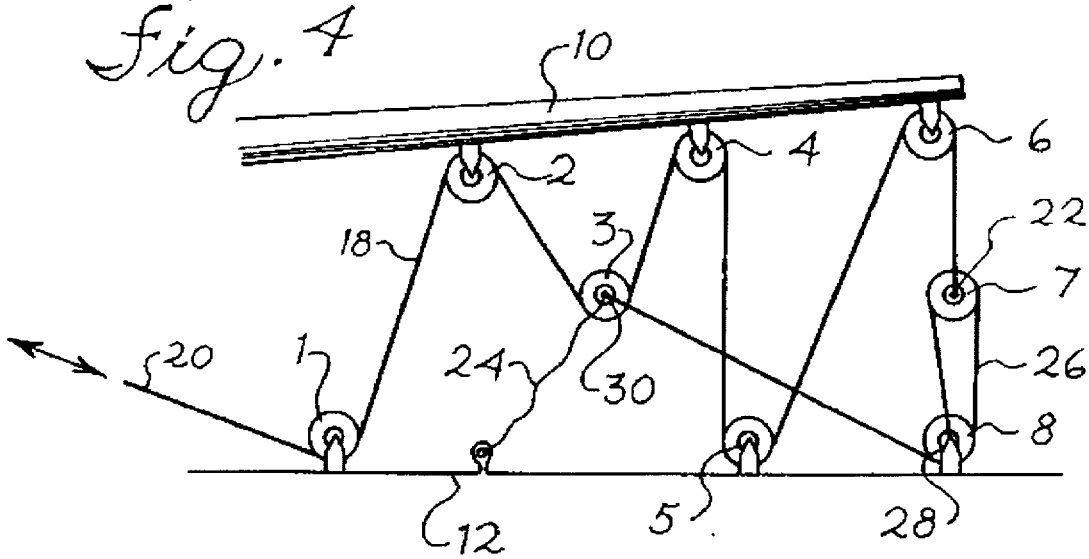
FIG. 4 is an overall schematic showing the system of FIG. 1.
Figure 5:
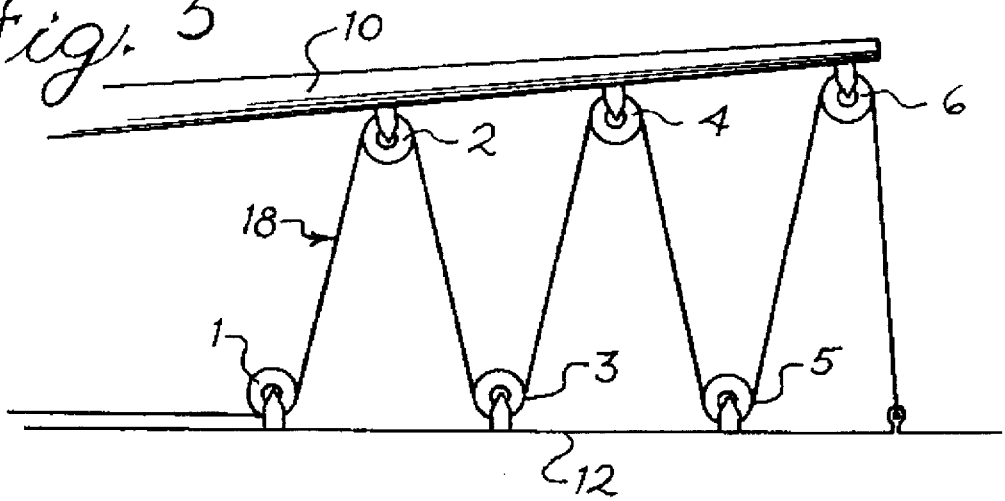
FIGS. 5 and 6 are schematics showing the system of FIGS. 1—4 in coarse and fine adjustment mode.
Figure 6:
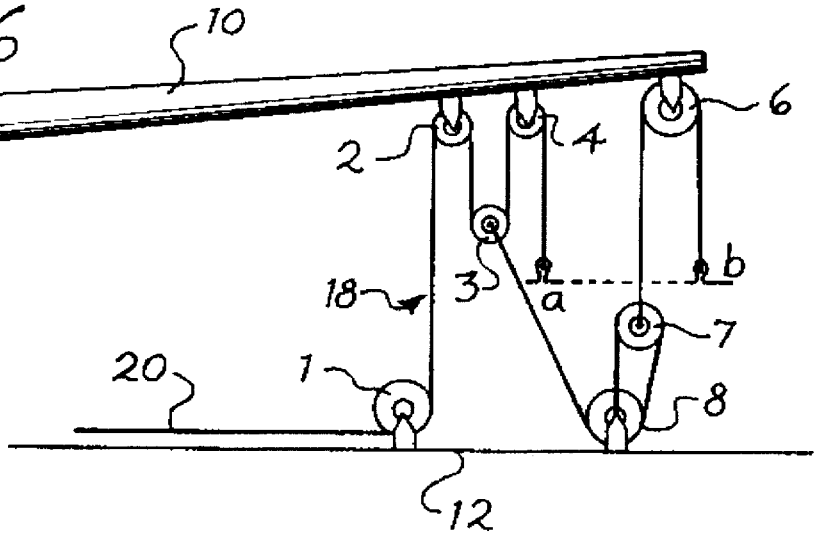

In general, the block and tackle system comprises a first plurality of blocks, with the upper blocks being connected or secured to the boom of a sailboat, designated by the horizontal line 10 in FIGS. 4–6, and a second plurality of blocks connected or secured to the deck, as indicated by the horizontal line 12 in FIGS. 4–6. The boom 10 can move horizontally and vertically, and the mainsheet system is used to control the position of the boom and associated sail, as is well known in the art. Also, the heads of the respective blocks associated with boom and deck may be mounted on common frames 14 and 16 to enable attachment at single locations, as shown in FIGS. 1–3.

As shown in FIGS. 1–6, the system comprises a primary line or mainsheet 18 having a free end 20 and a bitter end 22 connected to components of the system.

Figures 1, 2, 3:
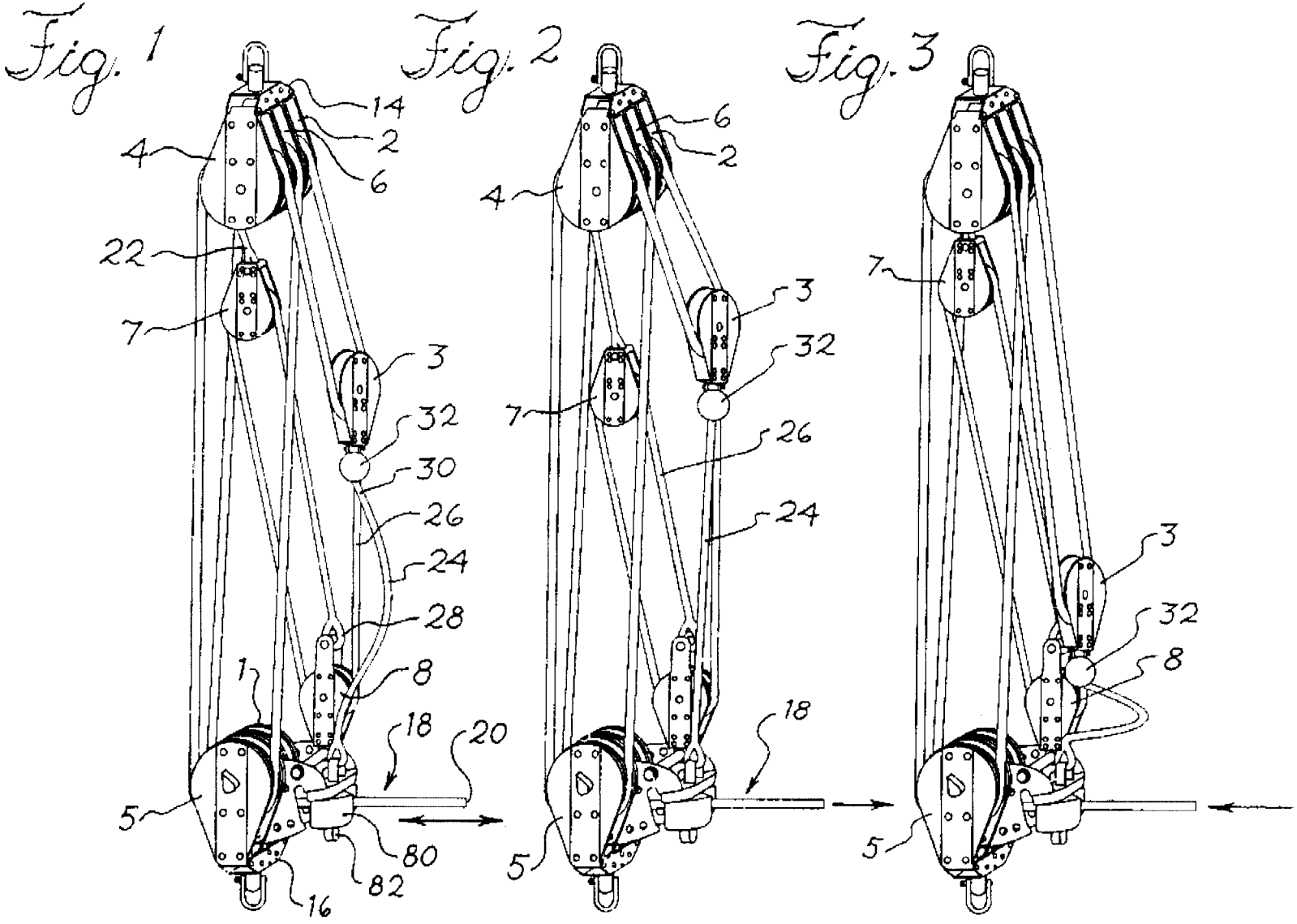
FIGS. 1, 2 and 3 are perspective views of one preferred block and tackle system of the present invention, illustrating the system in its three operating modes.

FIGS. 1–3 illustrate the same system in three different modes of operation. As best shown in FIG. 4, the blocks have been numbered consecutively from the free end 20 of the line as blocks 1 through 8, with blocks 2, 4 and 6 being connected to the boom 10 and blocks 1, 5 and 8 being connected to the deck. Block 5 is a one-way block, such as a ratchet block, having no rotation in the line release direction, i.e., when the free end 20 of the line is moved toward the right when referring to FIG. 4.

A first important aspect of the present invention is a floating block 3 between the deck and boom reeved between a pair of blocks 2 and 4 on the boom 10, with the floating block being connected by a flexible inextensible tether 24, such as a length of line, to the deck 12. The positions of operation of the tethered block are between a position near the deck and a position in which the tether is fully extended.

A second important feature of the invention is the one-way block 5 which is mounted on the deck or boom in a position downstream of the tethered block or between the tethered block 3 and the bitter end 22 of the mainsheet 18. The one-way block 5 enables motion to occur in the secondary system when the mainsheet is initially eased, allowing operation of the secondary system in cooperation with a portion of the first, effecting an overall higher purchase. In effect, components of the secondary system located prior to or upstream of the one-way block are added to components of the primary system located after or downstream of the one-way block.

In the embodiment shown in FIG. 4, the secondary system comprises a secondary line 26 of finite length having one end 28 secured to the deck 12 and the other end 30 secured to tethered block 3. As shown, line 26 is passed around a floating block 7 secured to the bitter end 22 of mainsheet 18, and around block 8 secured to the deck. The blocks 7 and 8 and the secondary line are inactive when the tether 24 is fully extended or collapsed. Hence, the primary system operates at a 6:1 ratio as shown in FIG. 5.

When the mainsheet is first eased, the tether 24 is partially relaxed, as shown in FIG. 1, allowing movement of the secondary line 26 and operation of the system at a 12:1 ratio within the limits or lengths of the tether, as shown schematically in FIG. 6. The mainsheet effectively becomes locked at the one-way block 5. In FIG. 6, points a and b represent securement of the mainsheet to a common framework, which in reality, is the one-way block 5.

A description of the operation will facilitate a better understanding of the system. When the line 18 is hauled or sheeted in, as shown by the arrow in FIG. 2, the tether 24 is fully extended, and the line 26 is tight and does not move, thus in effect establishing a single line connection between the bitter end 22 of mainsheet 18 and the deck. This establishes the 6:1 relation as shown in FIG. 5.

In order to use the higher ratio, the mainsheet is initially eased out or moved to the left when viewing FIG. 2. As the line is eased, mainsheet 18 is locked at the one-way block 5, and hence the tether 24 develops slack or partially collapses as shown in FIG. 1, and the previously stationary secondary system blocks 3 and 7 are set in motion. This results in operation at the higher ratio, as shown in FIG. 6.

Operation of the fine adjustment mode occurs when there is slack in the tether, or between the positions of block 3 as shown in FIGS. 2 and 3.

As shown, a stop 32 is provided on the base of tethered block 3. If the mainsheet is sufficiently eased, as shown in FIG. 3, the stop 32 comes into contact with block 8, preventing further movement of the blocks 3 and 7 of the secondary system. Thus, the secondary line 26 acts as a single line in the ease direction, in effect increasing the tension on the bitter end 22 of mainsheet 18, and causing the line to slide through ratchet block 5, at a 6:1 ratio. Rather than using a stop, a second tether may extend from the boom to the tethered block 3.

With the block and tackle system in the configuration shown in FIG. 3, the line may be continued to be eased in the 6:1 ratio. If the line is then hauled in, the system first reverts to the 12:1 ratio (FIG. 1) until the tether 24 is fully elongated, and the 6:1 ratio again prevails. For example, when changing directions, the boom may be allowed to move outwardly with a quick release of the line at a 6:1 ratio. The line or sheet may then be rapidly trimmed in through an initial 12:1 and then 6:1 ratio until the desired mainsail or boom position is achieved. Subsequent mainsail easing and trimming cycles, which are performed to accommodate variations in wind speed or sea state, may then be made in the fine adjustment (12:1) mode. Thus, in many cases, it may be desirable to slightly overtrim the line in the low ratio and then ease the line back into the high ratio, to enable this fine tuning.

Figure 7:
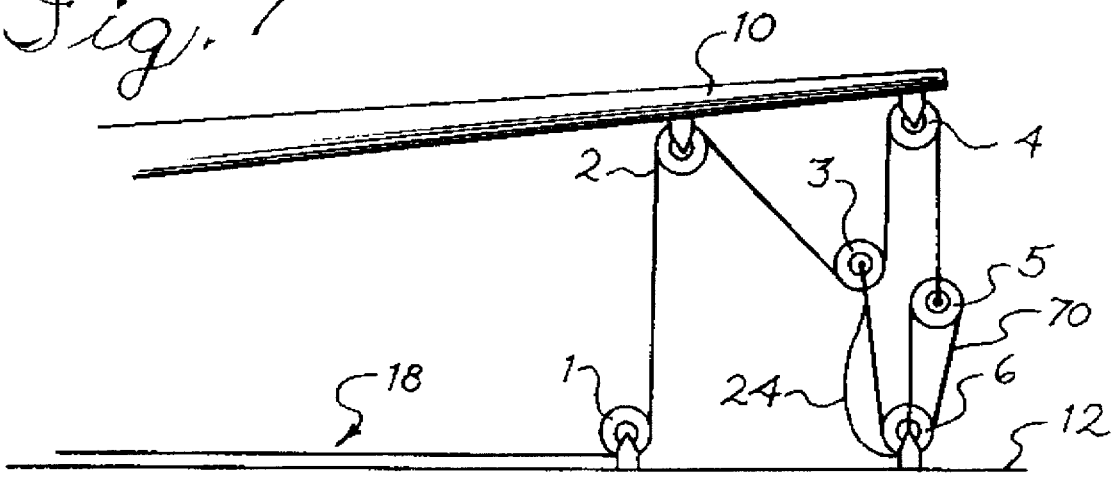
FIG. 7 is a schematic side view of a more simplified version having different speed ratios than the one shown in FIGS. 1–6.

FIG. 7 shows a more simplified system having a coarse ratio of 4:1 and a fine ratio of 7:1. The pulleys are numbered from the free end to the bitter end of the line and comprise pulleys 1, 2, 3, 4, 5 and 6. Pulleys 2 and 4 are connected to the boom 10, with pulley 4 being the one-way block. Pulleys 1 and 6 are secured to the deck 12. Pulley 3 is the floating tethered pulley, and pulley 5 is a floating pulley secured to the bitter end of the mainsheet 18. A secondary line 70 is connected to the deck and passes around floating pulley 5, around deck pulley 6, with the other end being secured to the tethered block 3.

The greatest changes in speed ratios between coarse and fine modes are obtained if the bitter end of the mainsheet terminates in one or more floating pulleys, and a secondary line is employed. The system is still operable, however, if the terminal floating pulley is omitted and the mainsheet simply reeved back to the tethered pulley.

Figure 8:
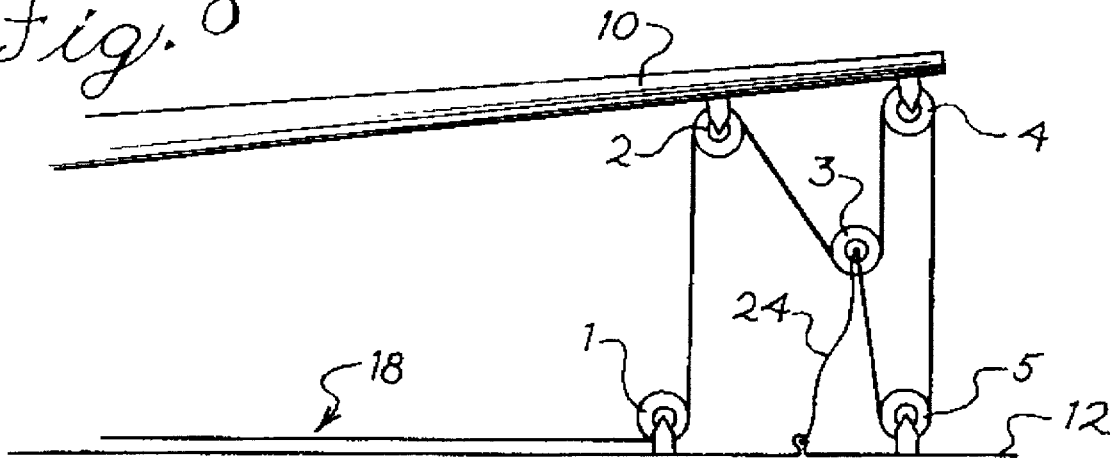
FIG. 8 is a schematic side view of an even more simplified version.

FIG. 8 shows a tackle system in which the line is reeved over entry pulley 1 on the deck, around boom pulley 2, around tethered floating pulley 3, around a second boom pulley 4, around a second deck pulley 5 and back to tethered pulley 3. In this example, the one-way block is located at position 4. In this example, the coarse mode is 4:1 and the fine mode is 5:1.

It will be apparent that additional pulleys may be added in each component of the system to increase the purchase of such component. For example, the system shown in FIG. 1 could have double pulleys at positions 7 and 8 for the secondary line.

Figure 9:
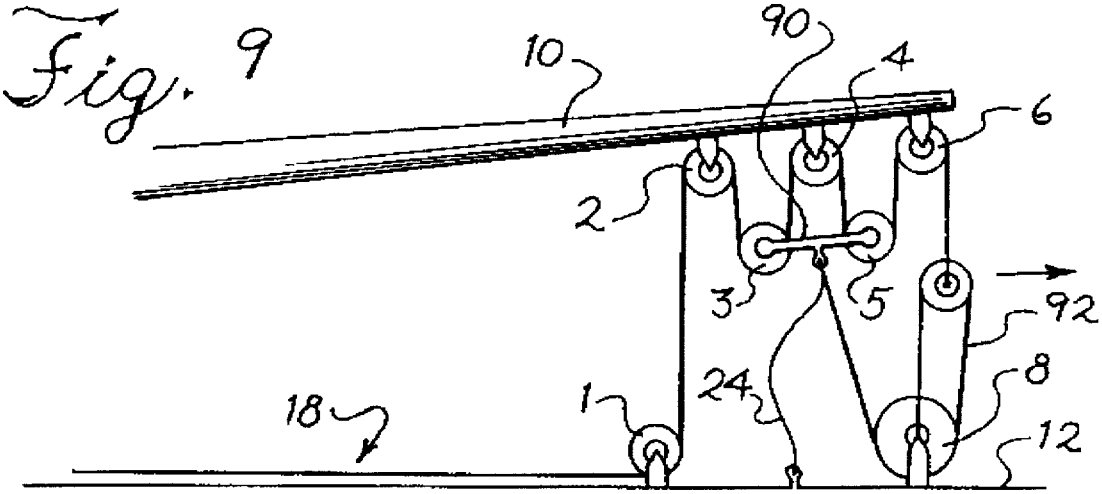
FIG. 9 is a schematic view showing a system using multiple floating pulleys in the secondary system.

FIG. 9 shows a system in which the initial floating block comprises a pair of blocks 3 and 5 secured together in a spaced relationship by a frame 90. The block 6 is a one-way block, and secondary line 92 is secured to block 8, passes around blocks 7 and 8, and is secured to the frame 90. The tether 24 is also secured between the deck 12 and the frame 90. In this embodiment the lower ratio is 6:1 and the higher ratio is 13:1.

FIGS. 10 and 11 illustrate a conventional ratchet block which may be used as the one-way block in connection with the present invention. This block is conventional and is described in Gilson U.S. Pat. No. 3,714,838 and incorporated herein by reference. The general purpose of such block is to enable sufficient friction to be developed between the line and the sheave to prevent the line from moving on the sheave when in the fine adjustment mode. This is accomplished by means to lock the sheave against rotation in the ease or release direction. The maximum amount of available friction force is determined by various factors, such as the surface of the sheave, the degree of wrap of the line on the sheave, the resultant force of the line against the sheave, and the diameter of the sheave.

In the preferred embodiment, the ratchet block shown in FIGS. 10 and 11 comprises a pair of side plates, of which one is shown at 60, a rotatable sheave 62 supported for rotation by bearings 64, with the inner annular wall of the sheave having inclined teeth 66. The inner hub or race comprises a pawl 68 urged by a spring 70 into engagement with the teeth 66 in a manner that rotation is permitted in one direction and prevented in the other. As shown in FIG. 10, the sheave 62 may have a specially designed V-shaped groove 71 for receiving the line and for providing an increased gripping force as tension increases. This may, for example, comprise a plurality of prismatic notches 72 which define a plurality of relatively sharp corners 74 around the groove. Other sheave configurations would appear to equally suitable, and many are known.

To provide additional elements of control, as shown in FIG. 1, the lead block 1 may also be a ratchet block, and the associated framework may carry a cam cleat 80 and fairlead 82 to permit releasable securement of the line in a desired position.

From the foregoing, it will be understood that the one-way block can be attached to either the deck or the boom, depending on the particular configuration. Also, the tethered block and elements of the secondary system can be secured from either the deck or the boom, with the only proviso being that the line leading back from the secondary system should pass around a block secured to the same part to which the tethered block is secured. Finally, it may be seen that the systems as shown can be inverted, especially with the addition or removal of one or more blocks.

Also, it may be seen that countless varieties and ratios of the present system are available in theory, whereas practical considerations may dictate a particular type of system or a particular combination of ratios. Also, most standard one-way blocks have a standard line gripping or drag value. This value should be somewhat greater than the purchase of the secondary system. If the value is too high, however, the line would be difficult to release in the coarse mode. If the drag value is too low, the line may not remain stationary at the one way block, preventing activation of the secondary system. The drag value of the one-way block can be changed by alterations to the configuration of the groove in the sheave about which the line passes.

We claim:

1. A multiple purchase block and tackle system connected between first and second spaced objects, said system comprising a primary system, a floating block in said primary system, a secondary system connected to said floating block, and one way block means between said primary and secondary systems, at least one line means reeved in said primary and secondary systems for operation in haul and ease directions, said one way block means releasably locking said line means in the each direction, said secondary system being operable upon initial ease of said line means to allow movement of said floating block, and an inextensible flexible tether secured to one of said first and second objects and said floating block for limiting movement of said floating block.

2. The block and tackle system of claim 1 wherein said primary system comprises first and second blocks secured to said first object, said line means being reeved in order through said first block, said floating block and said second block, and said tether being secured to said second object.

3. The block and tackle system of claim 1 wherein said line means comprises a line having a free end and a bitter end, and a second floating block in said secondary system secured to the bitter end of said line.

4. The block and tackle system of claim 3 additionally comprising a second line of finite length operatively reeved through said second floating block and having one end secured to said first floating block.

5. The block and tackle system of claim 1 wherein said line means comprises a single line having a free end and a bitter end, said bitter end being secured to said floating block.

6. The block and tackle system of claim 1 wherein said system is secured between first and second objects, and wherein said system comprises a plurality of blocks secured to said first object, and plurality of blocks secured to said second object, and said one-way block means being secured to one of said first and second objects.

7. The block and tackle system of claim 1 wherein said system operates at a first mechanical advantage beyond the limit of movement of said floating block, and wherein said system operates at a second, higher mechanical advantage within the range of movement of said floating block.

8. The block and tackle system of claim 1 wherein said primary system comprises opposed block means, and said secondary system is operatively connected to at least a portion of opposed block means.

9. The block and tackle system of claim 1 wherein said one-way block means comprises a sheave, said sheave being rotatable in the haul direction, and means for preventing rotation in the ease direction.

10. The block and tackle system of claim 9 wherein said sheave comprises a groove configured for frictionally gripping said line in the ease direction.

11. The block and tackle system of claim 9 wherein the means for preventing rotation in the ease direction comprises a ratchet mechanism.

12. The block and tackle system of claim 1 wherein the floating block in the primary system is a double block.

13. A multiple purchase block and tackle system comprising a primary system, a first floating block in said primary system, a secondary system connected to said first floating block, and a one way block means between said primary and secondary systems, a first line having a free end and a bitter end reeved in said primary and secondary systems for operation in haul and ease directions, said one way block means releasably locking said first line in the ease direction, a second floating block in said secondary system secured to the bitter end of said first line, a second line of finite length operatively reeved through said second floating block and having one end secured to said first floating block, said secondary system being operable upon initial ease of said first line to allow movement of said first and second floating blocks, and means for limiting movement of said first floating block between spaced locations.

* * * * *